United States Patent [19]

Moyer

[11] 4,207,734

[45] Jun. 17, 1980

[54] LED DIGITAL WATCH WITH USER CONTROL OF DISPLAY TIMING AND BRIGHTNESS

[75] Inventor: Norman E. Moyer, Newport Beach, Calif.

[73] Assignee: Hughes Aircraft Company, Culver City, Calif.

[21] Appl. No.: 925,597

[22] Filed: Jul. 17, 1978

Related U.S. Application Data

[63] Continuation of Ser. No. 756,299, Jan. 3, 1977, abandoned.

[51] Int. Cl.[2] ..... G04B 19/30

[52] U.S. Cl. ..... 368/83; 340/762; 368/227

[58] Field of Search ..... 58/50 R, 23 R; 340/762, 340/767, 782

[56] References Cited

U.S. PATENT DOCUMENTS

| | | | |
|---|---|---|---|
| 3,765,163 | 10/1973 | Levine et al. | 58/50 R |
| 4,094,139 | 6/1978 | Nomura et al. | 58/50 R |
| 4,114,366 | 9/1978 | Renner et al. | 58/50 R |

*Primary Examiner*—J. V. Truhe
*Assistant Examiner*—Leonard W. Pojunas, Jr.
*Attorney, Agent, or Firm*—W H. MacAllister; Gerald L. Cline

[57] ABSTRACT

A light emitting diode (LED) digital watch with circuitry which allows the watch user to adjust the amount of time the horological information is displayed and to adjust the brightness of the display.

2 Claims, 4 Drawing Figures

LED DIGITAL WATCH WITH USER CONTROL OF DISPLAY TIMING AND BRIGHTNESS

This is a continuation of application Ser. No. 756,299 filed Jan. 3, 1977, now abandoned.

BACKGROUND OF THE INVENTION

1. Field of the Invention

This invention relates to digital electronic watches and, more particularly, to a L.E.D. digital watch having circuitry which allows the watch user to adjust the amount of time that the horological information is displayed and the brightness of the display.

2. Description of the Prior Art

In the art, the L.E.D. digital watch user was unable to adjust the length of time that the display flashed on or the brightness of the watch display. The prior art digital watches hard wired the particular display parameters, such as the length of time that the display would flash on, the brightness of the display, and which horological information would be displayed.

Still other prior are digital watches provided a bonding option; that is, the digital watch's integrated circuit (IC) chips had a variety of information available on said IC chips, the manufacturer would choose one of these bonding options and hard wire the choice so that the user was unable to select which watch parameters he preferred.

In the present invention, the watch user can select which one of several different brightness levels he desires the horological information to be displayed at. This will vary with individuals depending upon his average ambient lighting and his desire to conserve power, i.e., to increase the battery life by decreasing power consumption. Also, in the present invention, the user can select the length of time that the display of horological information is to be flashed on. The length of time will vary depending upon his reaction time, personal preference, and desire to conserve battery power.

SUMMARY OF THE INVENTION

The LED digital watch with user control of display timing and/or brightness, in accordance with the invention, consists of brightness adjusting means for allowing the watch user to select the particular brightness level he desires for the LED display elements of the watch, and/or circuitry for selecting the length of time that the watch user desires the LED display elements to be flashed on.

Accordingly, it is an object of this invention to provide electronic circuitry in a LED watch which allows the watch user to adjust the brightness level of the LED display devices to a particular level which he desires.

It is a further object to provide electronic circuitry in a digital watch which allows the watch user to select the particular length of time which he desires that the LED display devices be flashed on.

The features of the present invention which are believed to be novel are set forth with particularly in the appended claims. The present invention, both as to its organization and manner of operation, together with further objects and advantages thereof, may be understood best by reference to the following description, taken in connection with the accompanying drawings.

A BRIEF DESCRIPTION OF THE DRAWINGS

DETAILED DESCRIPTION

Figure 1:
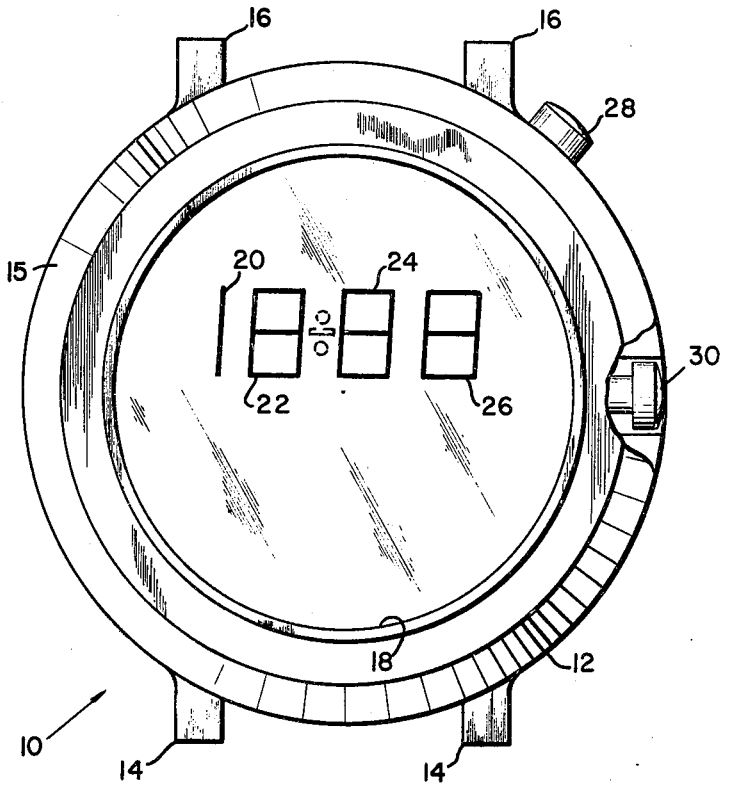
FIG. 1 is a top view of the digital watch of the present invention.

Referring now to FIG. 1, the digital watch 10 has a case 12 which is provided with watch-strap securing ears 14 and 16. The securing ears 14 and 16 are of such a nature that the usual watch strap can be attached thereon so that watch 10 can be carried upon the wrist of the wearer. In the preferred embodiment, the watch 10 is thus a wristwatch, although the same construction, circuitry and display can be employed in a pocket watch or pendant watch. Crystal 18 is mounted on the front of the watch case 12. Through the crystal 18 can be seen the light emitting diode (LED) display elements 20–26. A variety of horological information is displayed on these LED display devices by depression of the main push button 28. For example, by depression of the main push button 28. For example, by depressing main push button 28, either the moth, date, day, hour, minute, or second information can be displayed. Recessed push button 30 is used in conjunction with the main push button 28 to set the horological information.

In the preferred embodiment, if recessed push button 30 is depressed once, the digital watch will be placed in the month's slew enable state. Then, if main push button 28 is depressed, the month's information will be slewed at a one (or two) hertz pulse rate until the button is released, which sould occur when the desired information is displayed. If the recessed push button 30 is depressed a second time, the date information will be slewed whenever push button 28 is depressed. The third depression of the recessed button 30 will cause the day of the week information to be slewed when the main push button 28 is depressed. A fourth depression of the recessed button will cause the watch to be in the slew hours enabled state. A fifth depression of the recessed push button will place the digital watch in the slew minutes enabled state.

A sixth depression of the recessed push button 30 will cause a digital watch to be in the alter brightness state or mode. While in this mode the user can choose which of several different brightness levels he desires.

Finally, a seventh depression of the recessed button 30 will cause the digital watch to be in the alter-timing state or mode, which allows the user to select the particular length of time he wishes the horological information to be flashed on.

The eighth depresion of the recessed button returns the watch to its normal state.

Figure 2:
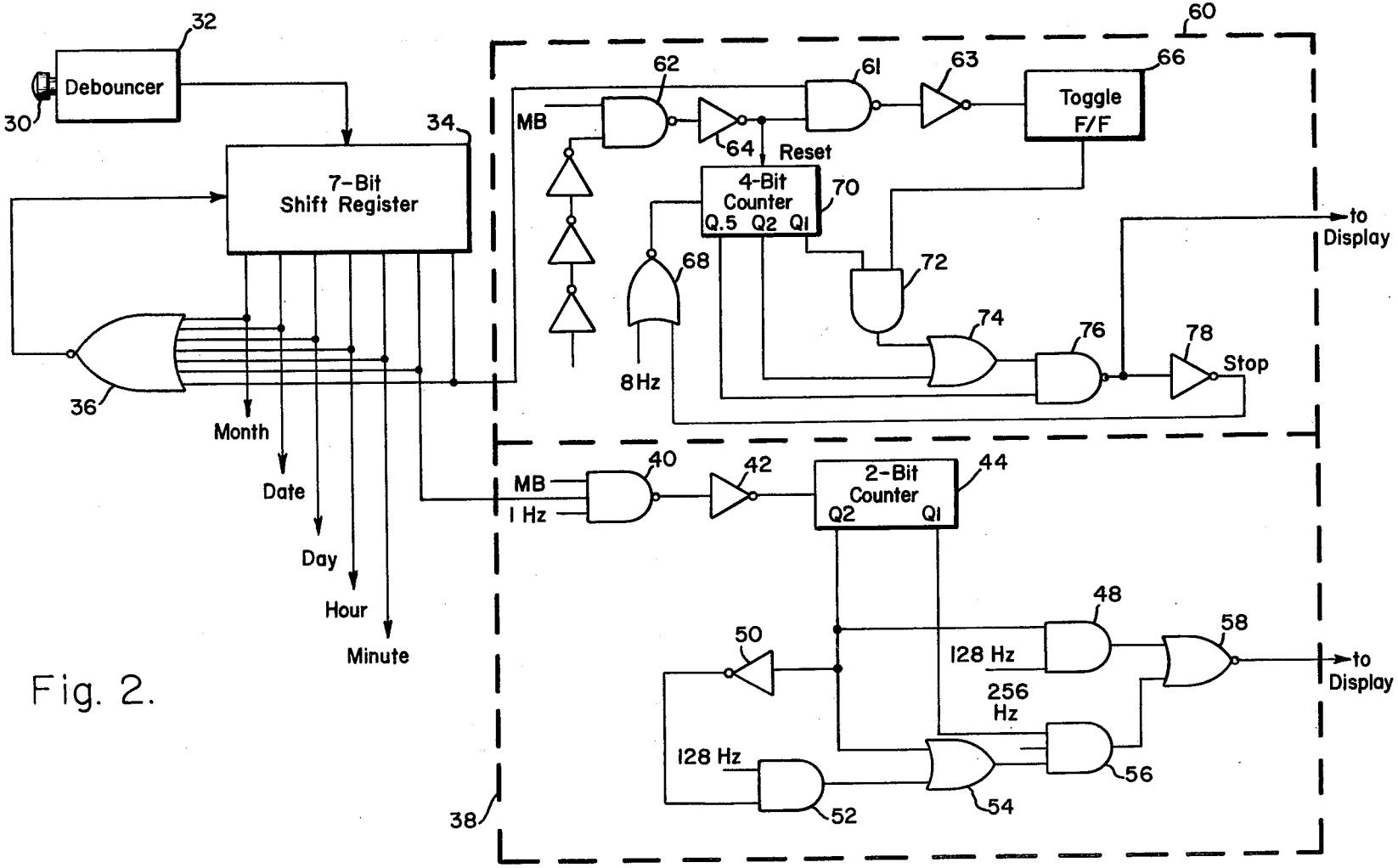
FIG. 2 is a block diagram of the logic circuitry to change display "on" time and display brightness.

FIG. 2 is a block diagram of the logic circuitry which controls (1) the brightness of the LED display elements and (2) the length of time that the display elements are illuminated. When recessed push button 30 is depressed a pulse from debouncer 32 is delivered to 7-bit shift register 34. This shift register is configured so that a single "1" propagates through until it is loaded with all "0's". All zeros enters a "1" and any "1" enters a "0". As described in connection with FIG. 1, one depression of recessed push button 30 places the digital watch in the months slew enable state. Then if main push button 28 is depressed the months information will be slewed until the correct or desired information is obtained. When the recessed push button 30 is depressed a second time the digital watch will be in the date enabled state and the date information will be slewed during the depression of the main push button 28. The third depression of the recessed push button 30 will cause a pulse from debouncer 32 to place the digital watch in the days slew enabled state; a fourth depression of the recessed push button 30 will cause the watch to be placed in the hours slew enabled state; a fifth depression of the recessed push button 30 will cause the watch to be in minutes slew enabled state; a sixth depression of the recessed push button 30 will cause the 7-bit shift register 34 to output a "1" on its sixth state, which is connected to a first input to NAND gate 40. A second input to NAND gate 40 is connected to main push button (MB) 28 and a third input to NAND gate 40 is connected to a one hertz narrow pulse wave train. The output of NAND gate 40 is connected through inverter 42 to the clock of 2-bit counter 44.

Brightness control logic circuitry 38 determines the duty cycle of the LED display. The $Q_1$ output from 2-bit counter 44 is connected to a first input to AND gate 56. The $Q_2$ output of 2-bit counter 44 is connected through inverter 50 to a first input to AND gate 52. The second input to AND gate 52 is connected to a 128 hertz clock pulse. The $Q_2$ output from 2-bit counter 44 is also connected to a first input to AND gate 48 and a first input to NOR gate 54. The second input to NOR gate 48 is connected to the 128 hertz clock pulse. The output of AND gate 52 is connected to a second input to NOR gate 54 and the output of NOR gate 54 is connected to a second input to AND gate 56. A third input to AND gate 56 is connected to a 256 hertz clock pulse. The output of AND gate 48 is connected to a first input to NOR gate 58 and the output of AND gate 56 is connected to a second input to NOR gate 58. Finally, the output of NOR gate 58 is connected to the circuitry which determines the duty cycle of the LED display devices 20 through 26.

Figure 3:
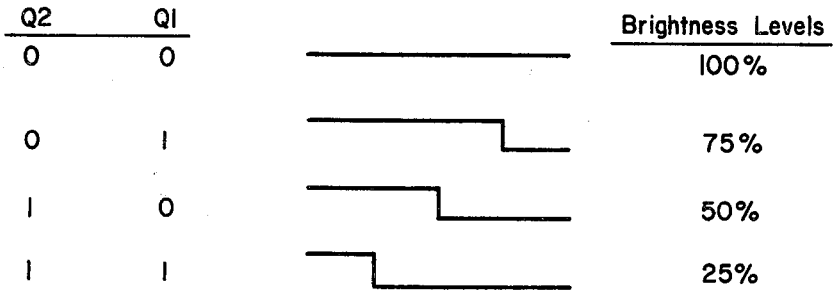
FIG. 3 shows the waveforms that can produce various brightness levels.

In operation, the brightness control logic circuitry 38 is enabled to change when a high binary level pulse is delivered from the 6th-bit of 7-bit shift register 34 to NAND gate 40. When the main push button 28 is depressed a high level binary signal is delivered via the MB input to NAND gate 40. With a high binary level signal on the first two inputs to NAND gate 40 the output of NAND gate 40 will be inverted by inverter 42 and a one hertz rate clock will be delivered to 2-bit counter 44 to clock said counter. At state "0," as shown in FIG. 3, the $Q_1$ and $Q_2$ outputs of the 2-bit counter 44 will be at a low binary level. Since both outputs are low, the outputs of AND gates 48 and 56 will be low. Therefore, since the two inputs to NOR gate 58 are at a low binary level the output of NOR gate 58 will be at a high level. It is not shown, but a "1" on the output of NOR gate 58 allows the display to turn on, a "0" forces the display off. This means that in the "0" state of counter 44 the display devices have a duty cycle of one, i.e., they are 100% enabled. The different brightness levels for the various states of $Q_1$ and $Q_2$ are shown in FIG. 3.

Figure 4:
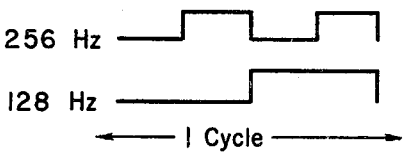
FIG. 4 shows two different pulse trains that can be used to derive the waveform of FIG. 3.

In the binary "1" (or second) state of 2-bit counter 44 the output $Q_1$ is at a high binary level and the output $Q_2$ is at a low binary level. The low level on $Q_2$ forces a low output on AND gate 48. The high binary level signal at $Q_1$ is delivered to AND gate 56 and the low signal from the $Q_2$ output is inverted by inverter 50 to a high binary level signal which is delivered to AND gate 52. Thus the output of AND gate 52 is high when 128 hertz is high, and the output of OR gate 54 is identical to AND gate 52. Therefore, when both the 128 hertz clock and the 256 hertz clock inputs which are shown in FIG. 4, are at a high binary level the output of AND gate 56 is also at a high binary level. This forces a low level on the output of NOR gate 58, turning off the display devices 20–26 when the 128 hertz clock and the 256 hertz clock are both at a high level. This occurs 25% of the time. This means that in the "1" state when $Q_1$ is high and $Q_2$ is low and display devices have a duty cycle of $\frac{3}{4}$, i.e., the display devices are enabled 75% of the time.

Therefore, if the watch user stops the slewing of the brightness levels at this second state with $Q_1$ high and $Q_2$ low the LED display devices will be operating at $\frac{3}{4}$ duty cycle or at 75% of their maximum brightness level.

In the binary "2" (or third) state of the 2-bit counter 44, $Q_1$ will be at a low binary level and $Q_2$ will be at a high binary level. Since $Q_1$ signal to AND gate 56 is low, the output of AND gate 56 will always be at a low level. The high binary level signal of $Q_1$ is delivered to AND gate 48, thereby causing AND gate 48 to deliver a high signal to NOR gate 58 whenever the 128 hertz clock is at a high level. Therefore, when the 128 hertz clock is at a high level the output from NOR gate 58 will be at a low level and will disable the display devices 20–26. The 128 hertz clock is at a high level 50% of the time, therefore, placing the digital watch display in a 50% or $\frac{1}{2}$ duty cycle. That is, if the watch user selects this state with $Q_1$ at a low level and $Q_2$ at a high level, the brightness of the LED display elements will be 50% of their maximum brightness level, as shown in FIG. 3.

Finally, if the 2-bit counter 44 is in the binary "3" (or fourth) state with both $Q_1$ and $Q_2$ at high levels, the output of AND gate 48 will be at a high level whenever the 128 hertz clock is high. Also, the output of AND gate 56 will be a high level whenever the 256 hertz clock is high. Thus, the output of NOR gate 58, which is delivered to the LED display element 20–26 is at a low binary level whenever the 256 or 128 hertz clock is at a high level. As seen in FIG. 3, this state occurs 75% of the time. If the digital watch user selects this particular state, where the $Q_1$ and $Q_2$ outputs are both at a high level the brightness of the LED display devices will be 25% of their maximum brightness level.

This same technique could be used with more waveforms to create outputs which are exponential rather than linear in rate. (That is $\frac{1}{2}$, $\frac{1}{4}$, $\frac{1}{8}$, 1/16.)

Timing control logic circuitry 60 determines the length of time that the horological information is to be flashed on LED display elements 20–26. The seventh output from the 7-bit shift register 34 is connected to a first input to NAND gate 61. A first input to NAND gate 62 is connected to the main push button 28 and a second input to NAND gate 62 is connected to MB thrice delayed. The output of NAND gate 62 is connected through inverter 64 to a second input to NAND gate 61 and to the RESET of 4-bit counter 70. The output of NAND gate 61 is connected through inverter 63 to the clock of toggle flip-flop 66. NOR gate 68 has a first input which is connected to an inverted 8 hertz clock pulse (wide duty cycle). The output of NOR gate 68 is connected to the clock input of a 4-bit counter 70. Four-bit counter 70 has three outputs; $Q_{0.5}$, $Q_2$, $Q_1$ where the subscript indicates the period in seconds. The $Q_{0.5}$ output is connected to a first input to NAND gate 76; the $Q_1$ output is connected to a first input to AND gate 72; and the $Q_2$ output is connected to a first input to OR gate 74. The output of toggle flip-flop 66 is connected to a second input to AND gate 72 and the output of AND gate 72 is connected to a second input to OR gate 74 whose output is connected to a second input to NAND gate 76. The output of NAND gate 76 is connected through inverter 78 to a second input to NOR gate 68. The output of NAND gate 76 is also connected to the display logic where it enables the display to light if a logic "1" is present.

Whenever the main push button (MB), i.e., push button 28 is depressed, all the outputs from 4-bit counter 70 are instantaneously reset to zero. The truth table shown below illustrates the various binary levels either a binary high signal (1) or a binary low signal (0) which are present at the various outputs $Q_{0.5}$, $Q_1$, and $Q_2$ of 4-bit counter 70 at the various states 0–15. The output signals of $Q_{0.25}$ are shown in this truth table even though this output is not connected. When the main push button 28 is depressed, after recessed button 30 has been depressed a predetermined number of times (in this embodiment depressing the recessed button 7 times places the watch in the timing adjust mode) a low level pulse is delivered from the output of NAND gate 62 and inverted by inverter 64 NAND gate 61 and inverter 63 to a high level pulse to the clock of toggle flip-flop 66. When the output of toggle flip-flop 66 is a high binary level signal which is delivered to AND gate 72, logic gates 72 and 74 cause a high binary level signal to be outputed from NAND gate 76 to the display devices 20–26 for the first 6 states (states 0–5) i.e., an 8 hertz pulse is delivered via NOR gate 68 to a 4-bit counter 70 for the first 6 states until the rising edge of state 6 when the logic gates 72, 74 and 76 make the STOP signal or output from inverter 78 go high, thereby, stopping the counting of the 4-bit counter 70.

Therefore, the high binary level signal is delivered to the display devices causing the devices to be turned on for 6 states or 6/8 or $\frac{3}{4}$ seconds.

When the main push button 28 is depressed a second time it will cause the output from toggle flip-flop 66 to toggle to a low binary level signal. With this low input to AND gate 72 the 4-bit counter 70 will count for 10 states at which time logic gate 72, 74 and 76 will cause a low binary level signal to be delivered to inverter 78 and a high stop signal to be delivered from the output of inverter 78 to the input of NOR gate 68, thereby, holding the output of NOR gate 68, at a low level so that 4-bit counter 70 will not accept any more of the 8 hertz pulses from NOR gate 68.

When the main push button 28 is depressed a second time, the output from toggle flip-flop 66 will be at a low binary level and will allow the 4-bit counter 70 to deliver a high binary level signal from NAND gate 76 to the display devices for 10 states, i.e., for 10/8 seconds. The display devices will be illuminated for 10/8 or $1\frac{1}{4}$ seconds.

| STATES | $Q_{.25}$ | $Q_{.5}$ | $Q_1$ | $Q_2$ |
|---|---|---|---|---|
| 0 | 0 | 0 | 0 | 0 |
| 1 | 1 | 0 | 0 | 0 |
| 2 | 0 | 1 | 0 | 0 |
| 3 | 1 | 1 | 0 | 0 |
| 4 | 0 | 0 | 1 | 0 |
| 5 | 1 | 0 | 1 | 0 |
| 6 | 0 | 1 | 1 | 0 |
| 7 | 1 | 1 | 1 | 0 |

-continued

| STATES | $Q_{.25}$ | $Q_{.5}$ | $Q_1$ | $Q_2$ |
|---|---|---|---|---|
| 8 | 0 | 0 | 0 | 1 |
| 9 | 1 | 0 | 0 | 1 |
| 10 | 0 | 1 | 0 | 1 |
| 11 | 1 | 1 | 0 | 1 |
| 12 | 0 | 0 | 1 | 1 |
| 13 | 1 | 0 | 1 | 1 |
| 14 | 0 | 1 | 1 | 1 |
| 15 | 1 | 1 | 1 | 1 |

Therefore, each depression of the main push button 28 will change the display "on" time and show the watch user how long the LED display devices will be illuminated, either $\frac{3}{4}$ second or $1\frac{1}{4}$ seconds. Naturally, if he decides to illuminate the LED display devices for only $\frac{3}{4}$ second (instead of $1\frac{1}{4}$ seconds) he will be conserving energy and increasing the lifetime of the battery.

The $\frac{3}{4}$ second and the $1\frac{1}{4}$ seconds time periods have been chosen as an example of two particular time periods which could be used. By using appropriate logic gates any desired timing sequence can be chosen. Also, by adding additional logic circuitry it would be possible for the watch user to choose from additional timing sequences. The user may desire to have a choice of 3 or even 4 different time periods from which to choose the particular length of time he desires the displays to be illuminated.

Although the device which has just been described appears to afford the greatest advantages for implementing the invention, it will be understood that various modifications can be made thereto without going beyond the scope of the invention, it being possible to replace certain elements by other elements capable of fulfilling the same technical functions therein.

What is claimed is:

1. A digital watch with LED display devices comprising:

a debouncer;

a clocking circuit for producing a plurality of clock pulses;

a shift register connected to said debouncer for selecting which mode the digital watch is in;

said shift register having an input and a plurality of outputs;

brightness adjusting means for allowing the watch user to select the particular brightness level he desires for the LED display devices;

a push button, depression of said push button causing said shift register to deliver a pulse to said brightness adjusting means;

said brightness adjusting means comprising:

a first NAND gate with a first, second and third input and an output;

said first input to said first NAND gate being responsive to said push button, said second input from said first NAND gate connected to said first output from said shift register, and said third input from said NAND gate being connected to receive a first clock pulse;

said output of said first NAND gate being connected to a first inverter gate;

the output of said first inverter gate being connected to the input of a counter having an input and a first and second output;

said first output of said counter being connected to a first input to a first AND gate having a plurality of inputs and an output, said second input to said first AND gate being connected to receive a second clock pulse and said third input to said first AND gate being connected to the output of a first OR gate;

a second inverter with an input and an output;

a second AND gate with a first and second input and an output, said first input being connected to receive a third clock pulse, and said second input being connected to said output of said second inverter;

a first OR gate with a first and second input and an output, said first input to said first OR gate being connected to said second output from said counter, said second input to said first OR gate being connected to said output from said second AND gate and said output from said first OR gate being connected to said third input to said first AND gate;

said second output from said counter being connected to said input of said second inverter and to a first input to a second AND gate and to a first input to a first OR gate;

said second input to said second AND gate being connected to receive said third clock pulse;

a first NOR gate having a first and second input and an output, said first input to said first NOR gate being connected to said output of said second AND gate, said second input to said first NOR gate being connected to said output of said first AND gate and said output of said first NOR gate being connected to said display device.

2. A digital watch with LED display devices comprising:

a debouncer;

a clocking circuit for producing a plurality of clock pulses;

a push button;

a shift register connected to said debouncer for selecting which mode the digital watch is in;

said shift register having an input and a plurality of outputs;

timing means for selecting the length of time that the LED display devices are to be flashed on;

said timing means comprising:

a plurality of inverters;

a first NAND gate with a first and second input and an output, said first, second and third inverters being connected between said push button and said first input to said first NAND gate, said second input to said first NAND gate being connected to said push button;

said output of said first NAND gate being connected to the input of a fourth inverter having an input and an output;

a toggle flip-flop having an input and an output, said input of said toggle flip-flop being connected to said output of said fifth inverter;

a second NAND gate with a first and second input and an output, said first input to said second NAND gate being connected to said first output and said shift register, said output of said second NAND being connected through a fifth inverter to said toggle flip-flop;

a counter with an input and a plurality of outputs, said output of said fourth inverter being connected to said second input to said second NAND gate and to said reset to said counter;

a first AND gate having a first and second input and an output, said first input to said first AND gate being connected to said output from said toggle flip-flop;

a first OR gate having first and second inputs and an output, said first input of said first OR gate being connected to said second output of said counter, said second input to said OR gate being connected to said output from said first AND gate;

a second NAND gate having a first and second input and an output, said first input from said second NAND gate being connected to said output from said first OR gate and said second input from said second NAND gate being connected to said third output from said counter;

a sixth inverter gate with an input and an output;

said output of second NAND gate being connected to the input of said sixth inverter and to said display devices;

a first NOR gate having a first and second input and an output, said first input of said first NOR gate being connected to the output of said sixth inverter gate, said second input to said first NOR gate being connected to receive a fourth clock pulse, and said output from said first NOR gate being connected to said input to said counter.

* * * * *